US007722094B2

(12) United States Patent
Kim

(10) Patent No.: US 7,722,094 B2
(45) Date of Patent: May 25, 2010

(54) LOCKING DEVICE FOR DOOR

(75) Inventor: Youn Jong Kim, Uiwang-si (KR)

(73) Assignee: Nautilus Hyosung Inc., Seoul (KR)

( * ) Notice: Subject to any disclaimer, the term of this patent is extended or adjusted under 35 U.S.C. 154(b) by 155 days.

(21) Appl. No.: 11/751,381

(22) Filed: May 21, 2007

(65) Prior Publication Data

US 2008/0012351 A1 Jan. 17, 2008

(30) Foreign Application Priority Data

May 26, 2006 (KR) ..... 10-2006-0047507

(51) Int. Cl.
*E05C 9/16* (2006.01)
*E05B 63/14* (2006.01)

(52) U.S. Cl. ..... 292/36; 70/108; 70/118

(58) Field of Classification Search ..... 70/104, 70/118, 283, 108, 119, 120; 292/32, 33, 292/36, 37, 38, 42

See application file for complete search history.

(56) References Cited

U.S. PATENT DOCUMENTS 1,002,340 A * 9/1911 Van Dusen ..... 292/37
2,039,124 A * 4/1936 Stryker ..... 292/36
2,347,705 A * 5/1944 Mosler et al. ..... 292/36
2,375,196 A * 5/1945 Cederwall ..... 70/118
2,392,874 A * 1/1946 Pelaez ..... 292/36
2,823,536 A * 2/1958 Watson ..... 70/118
3,158,016 A * 11/1964 Fay ..... 70/118
3,527,069 A * 9/1970 Tumbiolo ..... 292/37
4,114,933 A * 9/1978 Jankelewitz et al. ..... 292/37
4,468,943 A * 9/1984 Beattie et al. ..... 292/36
4,470,277 A * 9/1984 Uyeda ..... 70/118
4,621,845 A * 11/1986 Vanago ..... 292/37
5,437,484 A * 8/1995 Yamada ..... 292/36
5,470,115 A * 11/1995 Berg et al. ..... 292/335
5,778,708 A * 7/1998 Crosby et al. ..... 70/118
6,350,418 B1 * 2/2002 Venderpool et al. ..... 292/37
6,375,244 B1 * 4/2002 Smeltzer ..... 292/36
6,592,155 B1 * 7/2003 Lemley et al. ..... 292/36
6,623,051 B2 * 9/2003 Bonora ..... 292/330
6,688,657 B2 * 2/2004 Peacock et al. ..... 292/36
7,048,311 B2 * 5/2006 Sawatani et al. ..... 292/33

* cited by examiner

*Primary Examiner*—Peter M Cuomo
*Assistant Examiner*—Christopher Boswell
(74) *Attorney, Agent, or Firm*—Fish & Richardson P.C.

(57) ABSTRACT

A door locking device including: a door being mounted to an object to be capable of opening and closing a storage space of the object; a door handle being provided on a external surface of the door; a rotating bracket being mounted inside of the door to combine with a shaft of the door handle and thereby rotate together with the shaft; a rotating latch being provided between the door and the rotating bracket to rotate with the door handle, and detachably coupled with the rotating bracket along an axial direction of the shaft; a lock assembly being provided inside of the door to selectively restrain a rotation of the rotating latch; and a locking pin member being provided inside of the door to interoperate with the rotating latch, and selectively bind the door to the object according to a rotation manipulation of the door handle is provided.

9 Claims, 8 Drawing Sheets

LOCKING DEVICE FOR DOOR

CROSS-REFERENCE TO RELATED APPLICATION

This application claims the benefit of Korean Patent Application No. 10-2006-0047507, filed on May 26, 2006 in the Korean Intellectual Office, the disclosure of which is incorporated herein by reference.

BACKGROUND OF THE INVENTION

1. Field of the Invention

The present invention relates to a door lock structure, and more particularly, to a door locking device which can safely secure an object needing a protection, such as a safe and a financial Automatic Teller Machine (ATM).

2. Description of Related Art

A safe is utilized to secure cash, securities, jewelry, confidential documents, and the like. Specifically, the safe is utilized to protect an object from an unauthorized user's access. However, along with developments in safe manufacturing technologies, skills to illegally open the safe are also being improved. Accordingly, there is a need for a safe which is safer and can thwart theft. Particularly, a financial Automatic Teller Machine (ATM) is generally installed in a public location with great amounts of cash, and thus a necessity of safe safety becomes an issue.

A first objective of the safe is to prevent an unauthorized user from opening the safe even though the unauthorized user may utilize any instrument and method. A secondary objective of the safe is to stall for time to allow the police or a private security force to take an appropriate measure by making it difficult to open the safe when the unauthorized user attempts to force open the safe. Currently, various types of cutting tools and welding tools are developed and thus it may be almost impossible to manufacture a safe that an unauthorized user can never open. Accordingly, the most appropriate countermeasure is to manufacture a safe in which it takes time to open the safe when an unauthorized user attempts to force open the safe.

An article, associated with Underwriters Laboratory (UL) certification for safety regulations in the United States, specifies that a corresponding safe should not be opened by a safe specialist for about thirty minutes to be evaluated as a level one of the safety regulation. Specifically, when the entire device, such as an ATM, may not be moved, the device needs to be secured for a maximum possible time.

BRIEF SUMMARY

An aspect of the present invention provides a door locking device which can safely secure an object needing a protection, such as a safe and a financial Automatic Teller Machine (ATM).

An aspect of the present invention also provides a door locking device which can maintain a locked state of a door even when a door handle and a shaft of the door handle are damaged.

According to an aspect of the present invention, there is provided a door locking device including: a door being mounted to an object to be capable of opening and closing a storage space of the object; a door handle being provided on a external surface of the door; a rotating bracket being mounted inside of the door to combine with a shaft of the door handle and thereby rotate together with the shaft; a rotating latch being provided between the door and the rotating bracket to rotate with the door handle, and detachably coupled with the rotating bracket along an axial direction of the shaft; a lock assembly being provided inside of the door to selectively restrain a rotation of the rotating latch; and a locking pin member being provided inside of the door to interoperate with the rotating latch, and selectively bind the door to the object according to a rotation manipulation of the door handle. Through the above configuration, the shaft of the door handle may not directly connect with the rotating latch. Specifically, the shaft may indirectly connect with the rotating latch via the rotating bracket and be detachable from the rotating latch. Accordingly, although the shaft of the door handle and the rotating bracket, integrally formed with the shaft, are damaged due to the forceful shock from the outside, the rotating bracket and the rotating latch may be detachable from each other and thus maintain the locked state of the door. Accordingly, an unauthorized user needs to carry out another operation to disassemble the rotating latch and thus it is possible to delay an intrusion time to open the safe.

In an aspect of the present invention, the object may indicate a security apparatus to secure cash, securities, jewelry, confidential documents, and the like, and may generally include a safe, a financial ATM, and the like.

Also, the rotating bracket and the rotating latch may restrain each other's rotation and integrally rotate. For example, the rotating latch may be formed to have a first binding surface in parallel with both side portions of the circumferential surface of the rotating latch, and the rotating bracket may be formed in a yoke or "U" shape to have a second binding surface in both ends of the rotating bracket to be engaged with the first binding surface of the rotating latch. Also, the rotating bracket and the rotating latch may be formed in various shapes that are detachable along the axial direction of the shaft.

Also, the locking pin member may include: a link assembly rotatably connecting with the rotating latch; and a fixing pin rotatably connecting with the link assembly to thereby interoperate with the link assembly and be selectively protruded from the door, and a pinhole is formed in the object to receive a free end of the fixing pin. In this instance, depending upon embodiments, the link assembly may be constructed using a multi-link method, such as a two-fold link method, at least a four-fold link method, and the like. For example, the link assembly may include: a connecting link portion pivotably connecting with the rotating latch; and a rotating link portion rotatably connecting with the connecting link portion and the fixing pin to be rotatable on the door. Also, depending upon embodiments, it is possible to construct so that the rotation of the rotating latch may be transmitted to the fixing pin using various types of members, such as a rack, a pinion, and the like, instead of the link assembly.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION OF EMBODIMENTS

Figure 1:
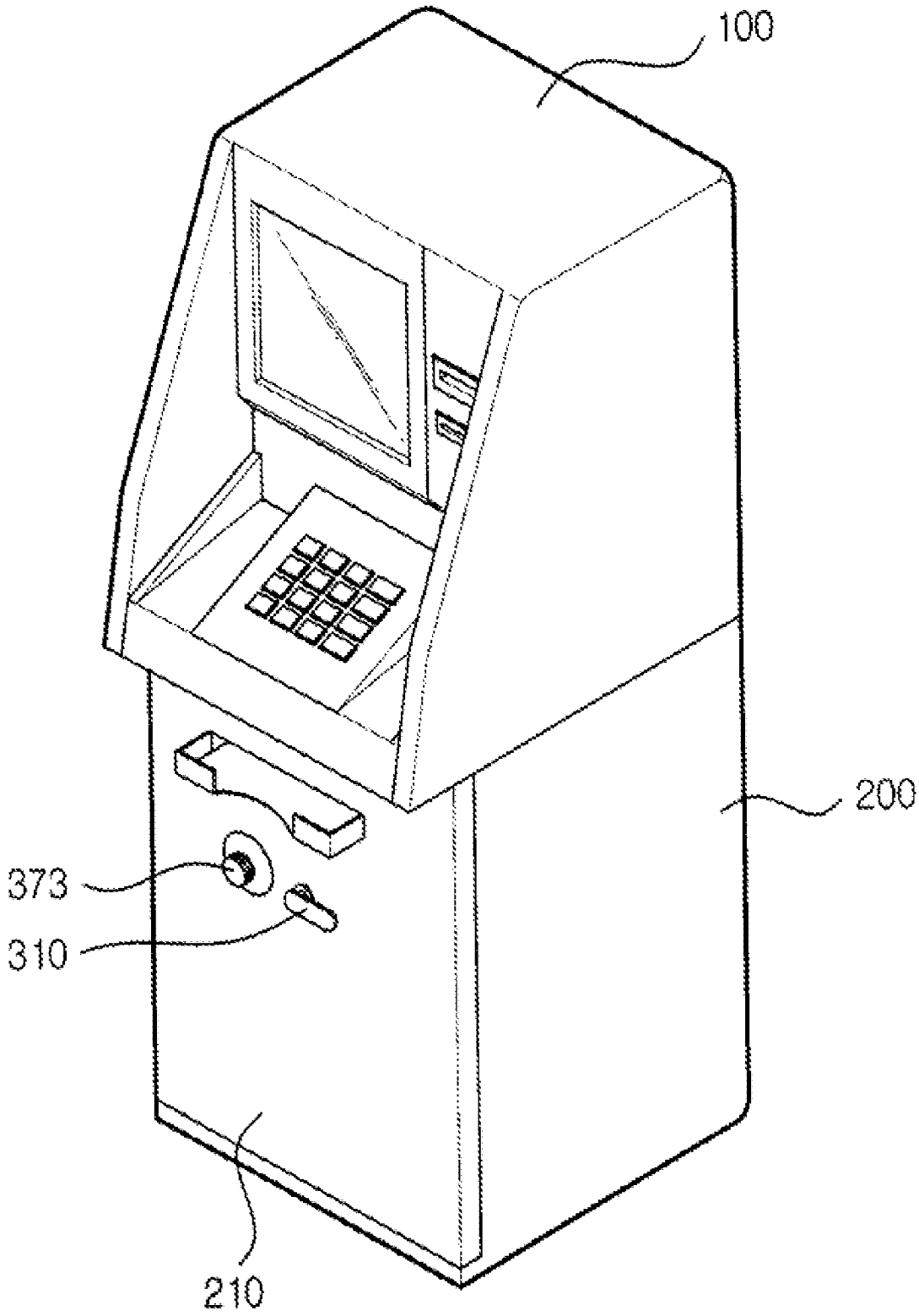
FIG. 1 is a perspective view illustrating a financial ATM using a door locking device according to an exemplary embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

Figure 2:
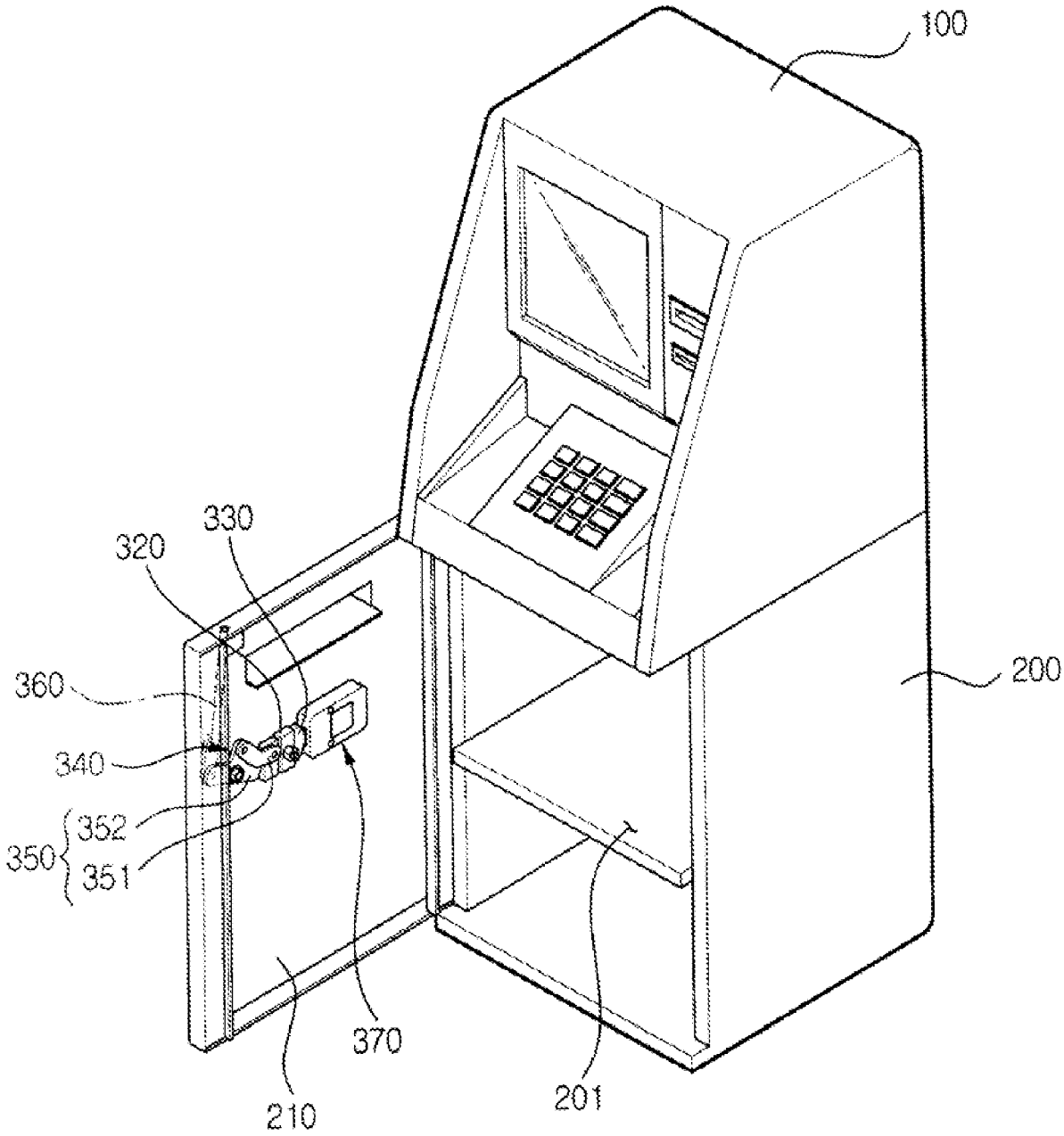
FIG. 2 is a perspective view illustrating a structure of a door locking device according to an exemplary embodiment of the present invention.

FIG. 1 is a perspective view illustrating a financial Automatic Teller Machine (ATM) using a door locking device according to an exemplary embodiment of the present invention, and FIG. 2 is a perspective view illustrating a structure of a door locking device according to an exemplary embodiment of the present invention.

Figure 3:
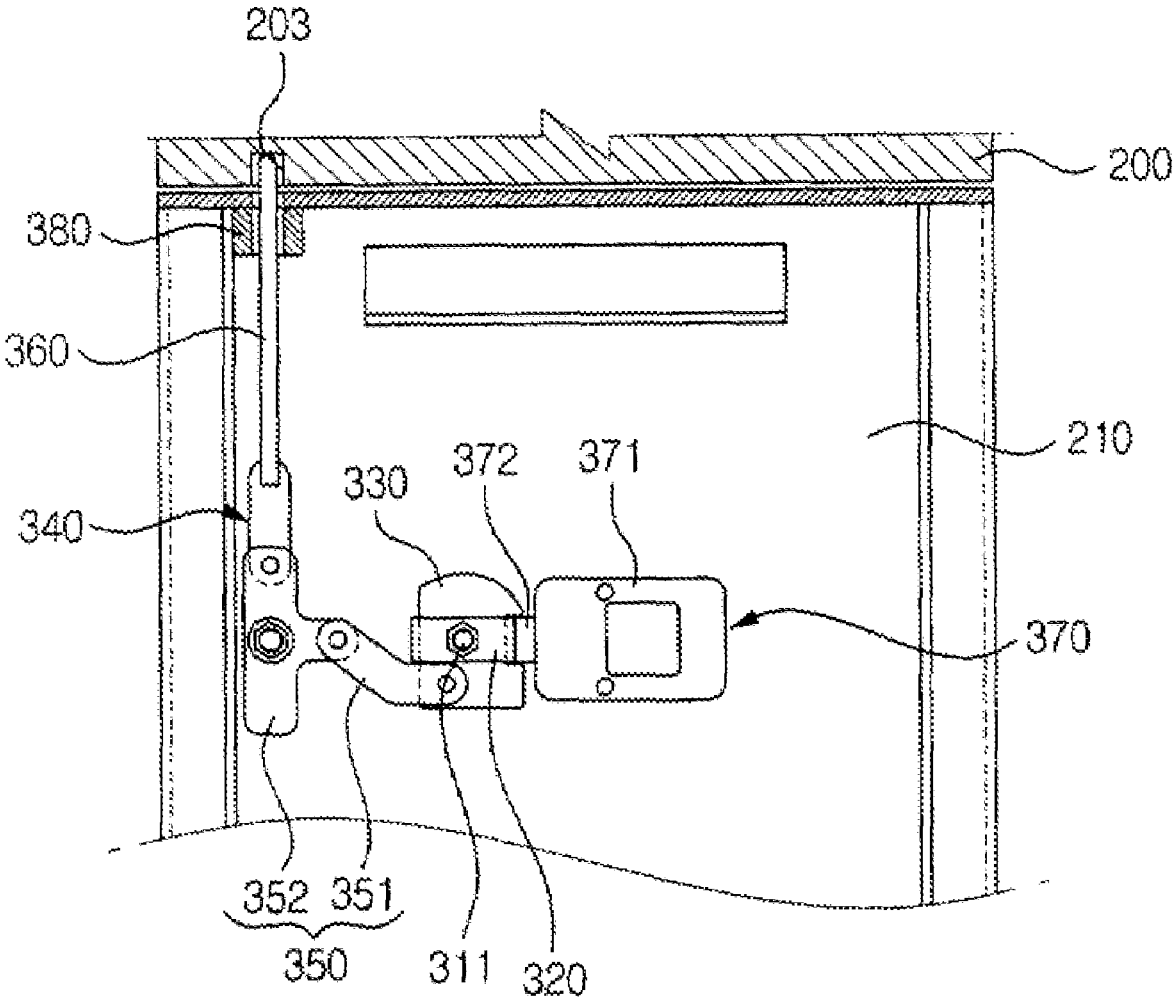
FIG. 3 is a plan view illustrating a structure of a door locking device according to an exemplary embodiment of the present invention.
Figure 4:
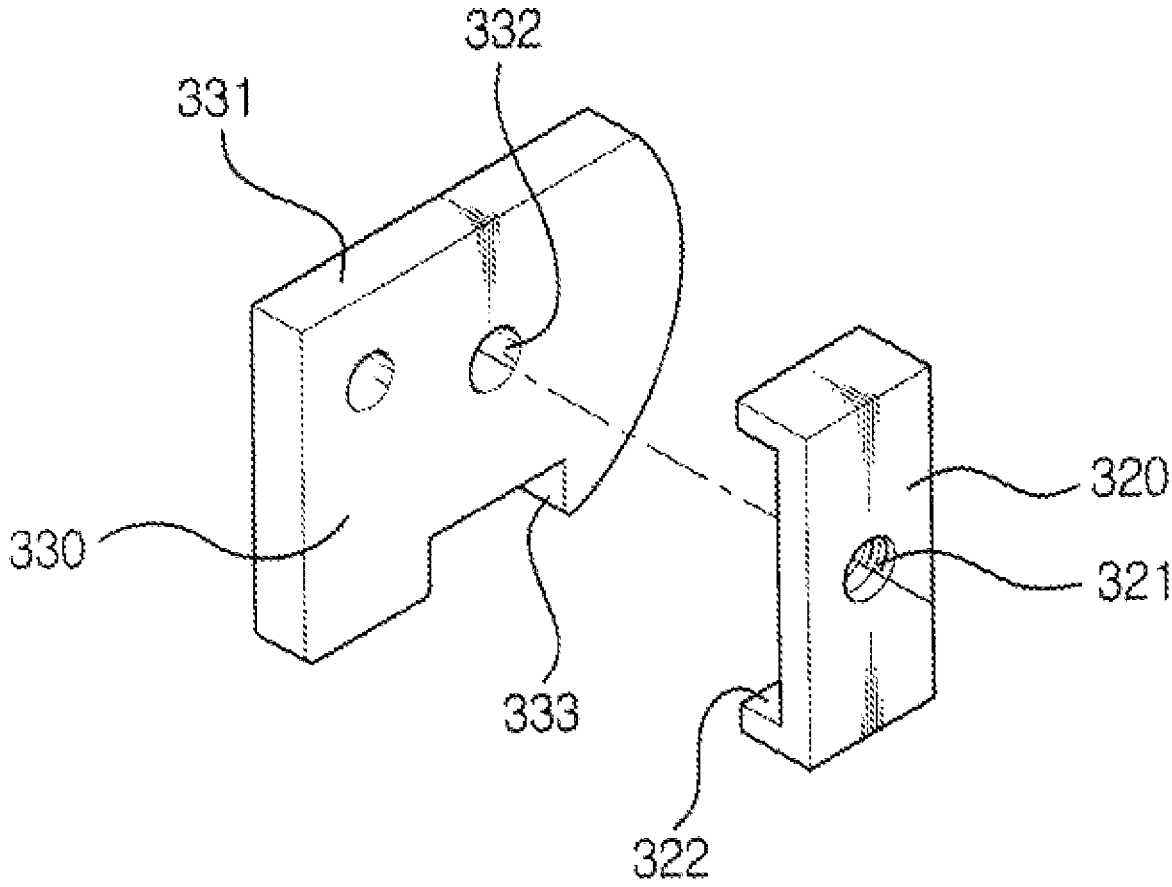
FIG. 4 is an exploded view illustrating a structure of a rotating bracket and a rotating latch of a door locking device according to an exemplary embodiment of the present invention.
Figure 5:
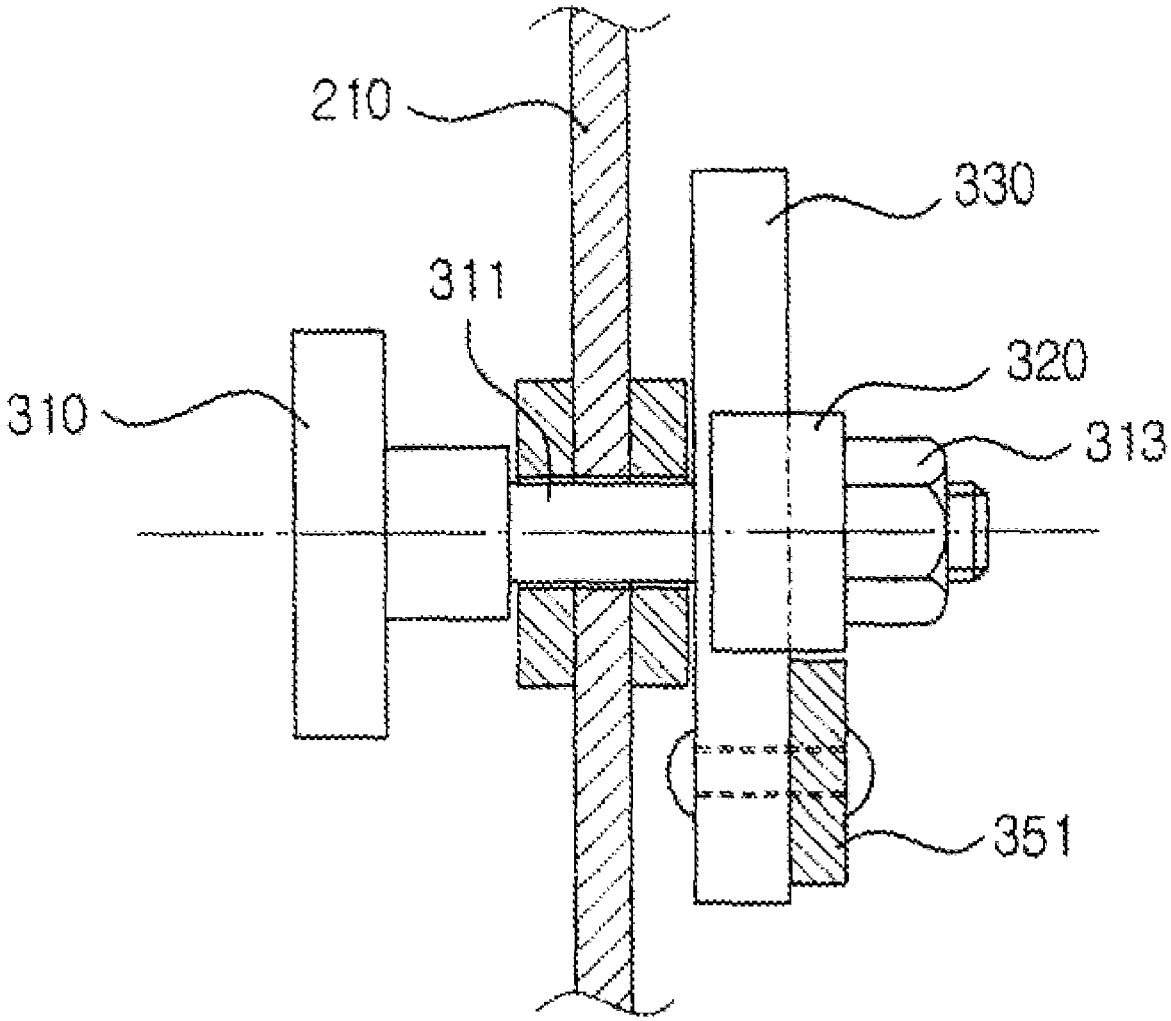
FIG. 5 is a cross-sectional view illustrating a structure of a rotating bracket and a rotating latch of a door locking device according to an exemplary embodiment of the present invention.

Also, FIG. 3 is a plan view illustrating a structure of a door locking device according to an exemplary embodiment of the present invention, FIG. 4 is an exploded view illustrating a structure of a rotating bracket and a rotating latch of a door locking device according to an exemplary embodiment of the present invention, and FIG. 5 is a cross-sectional view illustrating a structure of a rotating bracket and a rotating latch of a door locking device according to an exemplary embodiment of the present invention.

Referring to the figures, a door locking device according to an exemplary embodiment of the present invention includes: a door 210 being mounted to an object to be capable of opening and closing a storage space 201 of the object; a door handle 310 being provided on a external surface of the door 210 to be capable of manipulating a rotation; a rotating bracket 320 being mounted inside of the door 210 to combine with a shaft 311 of the door handle 310 and thereby rotate together with the shaft 311; a rotating latch 330 being provided between the door 210 and the rotating bracket 320 to rotate with the door handle 310, and detachably coupled with the rotating bracket 320 along an axial direction of the shaft 311; a lock assembly 370 being provided inside of the door 210 to selectively restrain a rotation of the rotating latch 330; and a locking pin member 340 being provided inside of the door 210 to interoperate with the rotating latch 330, and selectively bind the door 210 to the object according to the rotation manipulation of the door handle 310.

In this instance, the object indicates a safety apparatus to secure cash, securities, jewelry, confidential documents, and the like, such as a general safe, a financial ATM, and the like. Also, the financial ATM indicates an automated machine which can provide basic financial services, such as a cash withdrawal machine, a cash deposit machine, and the like, without restriction on a time and an occasion and also without a help of a teller.

Hereinafter, an example of a safe 200 of a cash withdrawal machine using a door locking device according to an exemplary embodiment of the present invention will be described.

As illustrated in FIGS. 1 and 2, the cash withdrawal machine includes a cabinet 100 which forms an external appearance of the cash withdrawal machine, and a plurality of modules which is provided for each functional unit and thereby installed in the cabinet 100. The functional unit modules include a magnetic card reading module, a bankbook arrangement module, a user interface module, a bill withdrawal module, and the like.

Also, the safe 200 having the storage space 201 is provided below the cabinet 100 to keep a cash cassette containing cash. Also, a front opening of the storage space 201 may be opened and closed by the door 210 that is combined with the safe 200 via a hinge. The closed state of the door 210 may be selectively maintained by the door locking device.

As illustrated in FIGS. 2 through 5, the door handle 310 is provided on the external surface of the door 210 to be capable of manipulating a rotation. A shaft 311 is integrally formed with the door handle 310 and thereby transmits an operating force of the door handle 310. Also, the shaft 311 passes through the door 210 and is protruded from the inside of the door 210.

The rotating bracket 320 is combined with the shaft 311 protruded from the inside of the door 210, and thus may integrally rotate together with the shaft 311. Also, the rotating latch 330 is rotatably provided between the door 210 and the rotating bracket 320. In this instance, the rotating latch 330 is selectively detachable from the rotating bracket 320 along the axial direction of the shaft 311.

Also, the rotating bracket 320 is combined with the rotating latch 330 to cover at least one portion of a circumferential surface of the rotating latch 330, and is formed with at least one of a first binding surface 331 and a second binding surface 322 in a contact surface between the rotating bracket 320 and the rotating latch 330 to thereby restrain the relative rotation. Accordingly, the rotating bracket 320 and the rotating latch 330 may integrally rotate and also be selectively separated from each other along the axial direction of the shaft 311.

Hereinafter, an example that the rotating latch 330 is formed in a non-circular shape having the first binding surface 331 in parallel with both side portions of the circumferential surface of the rotating latch 330, and the rotating bracket 320 is formed in a yoke or "U" shape to cover at least one portion of the circumferential surface of the rotating latch 330 and thereby combine with the rotating latch 330 will be described. In this instance, the second binding surface 322 is formed in both ends of the rotating bracket 320 to make a surface contact with the first binding surface 331 of the rotating latch 330. As described above, the rotating bracket 320 and the rotating latch 330 may be formed to have various types of shapes, such as a D-cut shape, and the like, depending on a required condition.

The present invention is not limited or restricted by the shape of the rotating bracket 320 and the rotating latch 330. However, it may be desirable that the rotating bracket 320 and the rotating latch 330 are formed to be readily separable from each other along the axial direction of the shaft 311.

Also, according to the present exemplary embodiment, a shaft hole 332 is formed in a central portion of the rotating latch 330, and the shaft 311 of the door handle 310 passes through the shaft hole 332. However, the present invention is not limited thereto and thus the shaft 311 of the door handle 310 may be constructed to not pass through the rotating latch 330.

Also, the shaft 311 and the rotating bracket 320 may be combined with each other by forming a male screw thread in an end of the shaft 311 and providing a combining hole 321 formed with a female screw thread in the rotating bracket 320. Also, the combination state may be fixed by a combining nut 313 and a washer provided on an outside of the rotating bracket 320. Also, depending upon embodiments, the shaft 311 and the rotating bracket 320 may be integrally formed using a combination method, such as a welding, and the like.

As described above, the rotation of the rotating latch 330 may be selectively restrained by a lock assembly 370 mounted inside of the door 210. The door assembly 370 includes a locking body 371 being provided inside of the door 210, and a lock 372 being received in the locking body 371 to be selectively externally withdrawn from the locking body 371. The lock 372, withdrawn from the locking body 371, may make a surface contact with the circumferential surface of the rotating latch 330 and thereby restrain the rotation of the rotating latch 330.

Also, since the locking body 371 mechanically or electrically connects with a locking module 373 provided on the external surface of the door 210, the lock 372 may be selectively withdrawn from the locking body 371 according to an operation of the locking module 373. In this instance, the locking module 373 may include a dial-type locking module, a keypad-type locking module, and the like, which are generally used for the safe 200, to enable only a particular user to utilize the safe 200.

Also, depending upon embodiments, a locking groove 333 may be formed in the circumferential surface of the rotating latch 330 to receive at least one portion of the lock 372 and thereby stably maintain a restrained state of the rotating latch 330 by the lock 372. Also, instead of the locking groove 333, a protrusion may be formed to hook the lock 372.

According to the present exemplary embodiment, the lock 372 directly makes a surface contact with the rotating latch 330 and thereby restrains the rotation of the rotating latch 330. However, the present invention is not limited thereto. Specifically, depending upon embodiments, the lock 372 may restrain the rotating bracket 320, which is combined with the rotating latch 330 to rotate together with the rotating latch 330, and thereby may restrain the rotation of the rotating latch 330 without directly restraining the rotation of the rotating latch 330.

The locking pin member 340 is provided inside of the door 210 to be interoperable with the rotating latch 330, so that the door 210 may be selectively retrained by the safe 200 according to the rotation manipulation of the door handle 310. In this instance, the locking pin member 340 includes a link assembly 350 rotatably connecting with the rotating latch 30; and a fixing pin 360 rotatably connecting with the link assembly 350 to thereby interoperate with the link assembly 350 and be selectively protruded from the door 210. Also, a pinhole 203 is formed in the safe 200 to receive a free end of the fixing pin 360.

The link assembly may include a connecting link portion 351 and a rotating link portion 352. The connecting link portion 351 is formed in an "L" shape and one end of the connecting link portion 351 pivotably connects with the rotating latch 330. Also, the rotating link portion 352 is formed in a "T" shape and rotatably provided inside of the door 210. In this instance, another end of the connecting link portion 351 pivotably connects with the rotating link portion 352. Also, one end of the rotating link portion 352 rotatably connects with one end of the fixing pin 360.

Also, since the fixing pin 360 rotatably connects with the rotating link portion 352, the fixing pin 360 interoperates with the connecting link portion 351 and the rotating link portion 352 according to the rotation manipulation of the door handle 310. In this instance, the fixing pin 360 may be selectively protruded from a top surface of the door 210. When a free end of the fixing pin 360 is externally protruded from the top surface of the door 210, the free end of the fixing pin 360 may be received in the pinhole 203 and thus the door 210 may be restrained to be maintained in the closed state.

Also, the link assembly 350 and the fixing pin 360 may rotatably connect with each other via a pin or a hinge. In this instance, a pin guide 380 may be provided inside of the door 210 to receive the free end of the fixing pin 360 and to guide the free end of the fixing pin 360 to stably perform a linear motion.

According to the present exemplary embodiment, the link assembly 350 includes the connecting link portion 351 and the rotating link portion 352 to transmit the rotary motion of the rotating latch 330 to the fixing pin 360, that is, the link assembly 350 is constructed using a two-fold link method. However, depending upon embodiments, the link assembly 350 may be constructed using a three-fold link method, a four-fold link method, and the like. In this instance, the present invention is not limited or restricted by the number of link portions.

In a normal state according to a structure constructed as described above, a disposition state of the rotating latch 330 may be supported and thereby fixed by the shaft 311 of the door handle 310 and the locking pin member 340. Even when the shaft 311 of the door handle 310 and the rotating bracket 320, integrally formed with the shaft 311, are damaged due to the forceful shock from the outside, the disposition state of the rotating latch 330 may be supported by the locking pin member 340.

Figure 6:
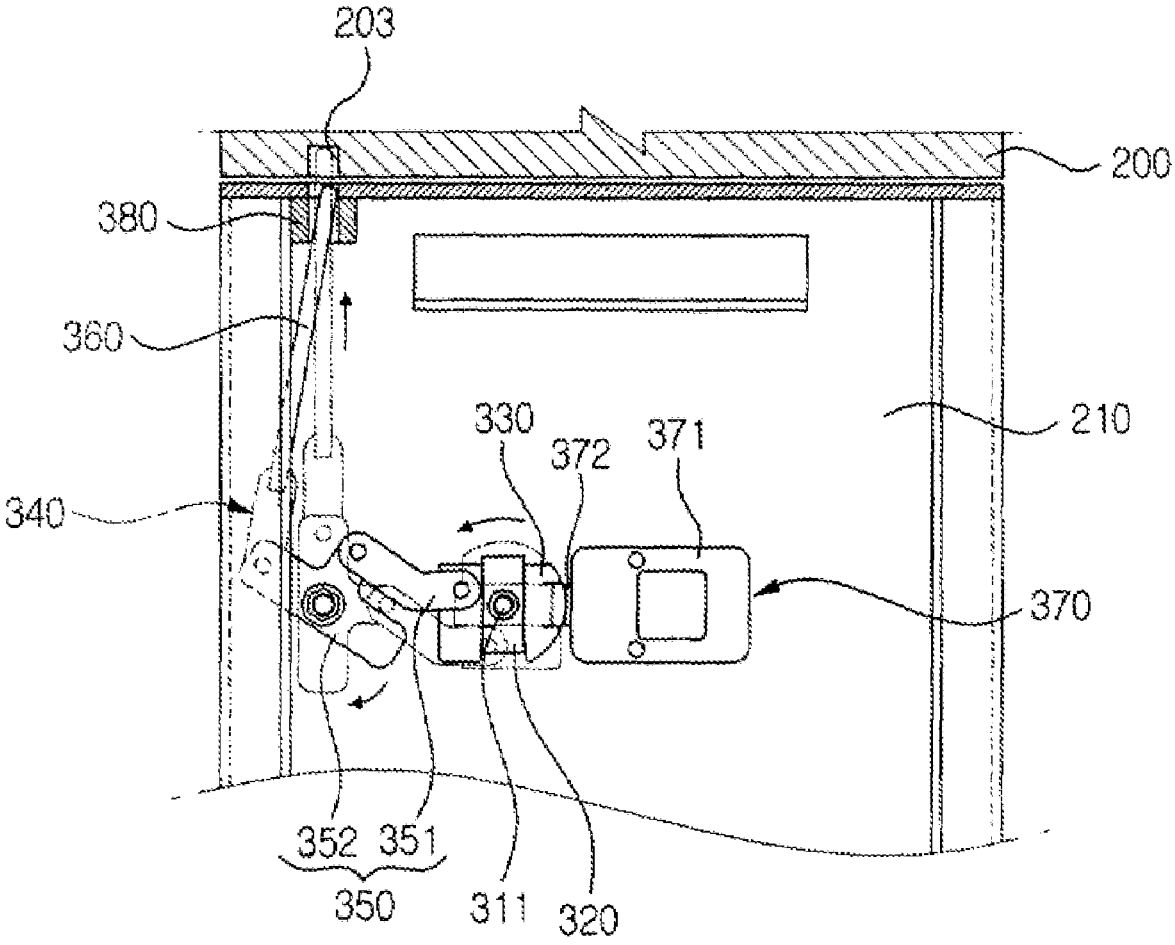
FIG. 6 is a plan view illustrating an operating structure of a door locking device according to an exemplary embodiment of the present invention.

FIG. 6 is a plan view illustrating an operating structure of a door locking device according to an exemplary embodiment of the present invention. Hereinafter, the operating state of the door locking device according to the present invention will be described with reference to FIG. 6.

When rotating the door handle 310 counter-clockwise based on the inside of the door 210 to restrain the locked state of the door 210, the shaft 311 is rotated counter-clockwise together with the door handle 310 and the rotating bracket 320 and the rotating latch 330 are also rotated counter-clockwise.

As the rotating latch 330 is rotated counter-clockwise, the connecting link portion 351 and the rotating link portion 352, connected thereto, respectively interoperate with the rotating latch 330, which results in the fixing pin 360 moving upwards and downwards, so that the free end of the fixing pin 360 may be externally protruded from the top surface of the door 210 and thereby the door 210 may be restrained to be maintained in a closed state. Also, the counter-clockwise rotated state of the rotating latch 330 may be selectively restrained by the lock 372 of the lock assembly 370.

Figure 7:
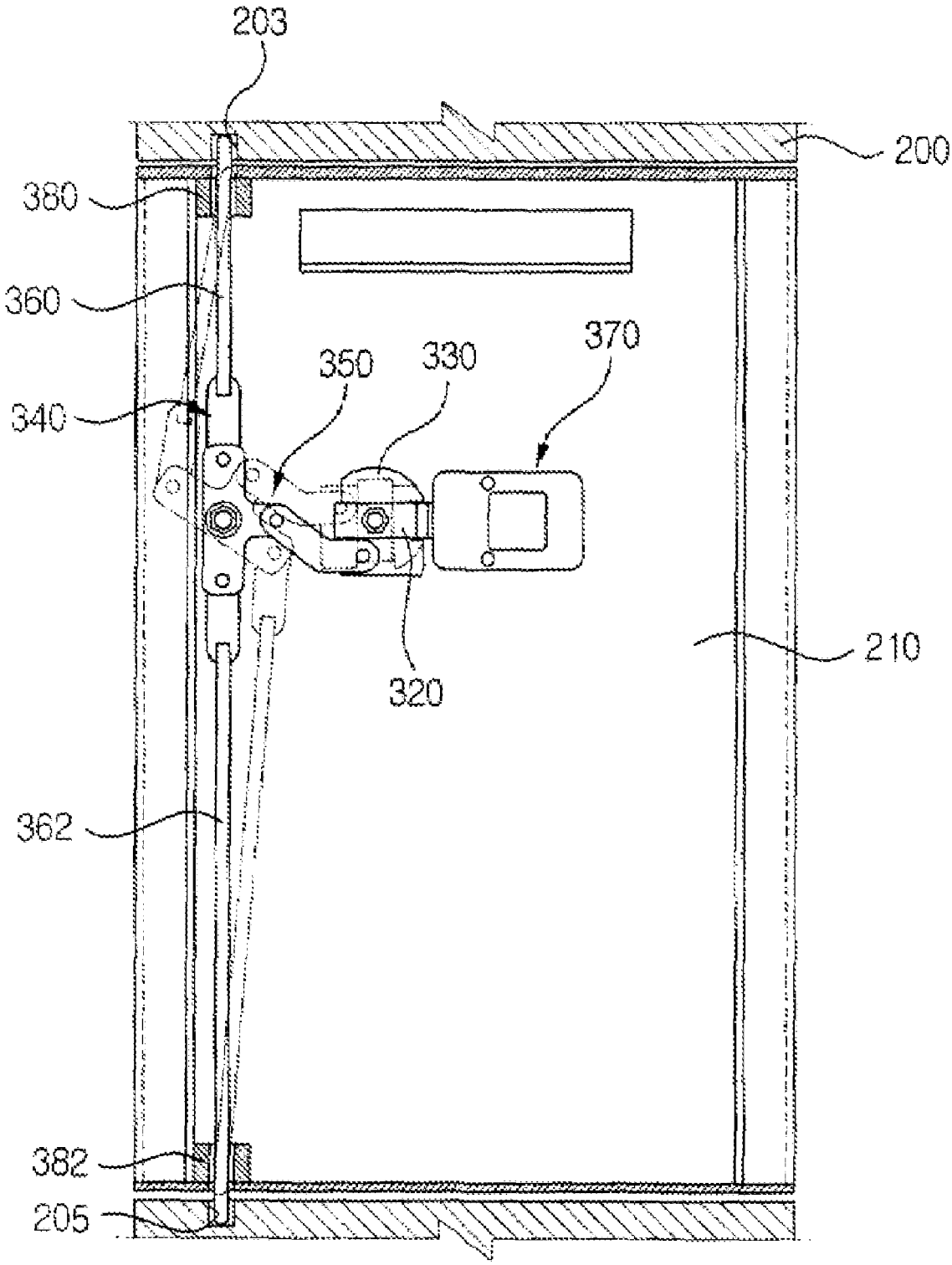
FIG. 7 is a plan view illustrating a structure of a door locking device according to another exemplary embodiment of the present invention.

FIG. 7 is a plan view illustrating a structure of a door locking device according to another exemplary embodiment of the present invention.

As described above, like reference numerals refer to the like elements and thus detailed descriptions related thereto will be omitted.

As illustrated in FIG. 7, a pair of fixing pins 360 and 362 may be provided to face each other by including the rotating link portion 352 in a central portion. Also, pin guides 380 and 382 may be provided in the top surface and a bottom surface of the door to receive the fixing pins 360 and 362 respectively. Through the above structure, the door may be further firmly restrained. Also, a structure may be simplified by enabling one link assembly 350 to interoperate with the pair of fixing pins 360 and 362 and thus parts and assembly processes may be reduced.

As described above, according to the present exemplary embodiment, the shaft 311 of the door handle 310 may not directly connect with the rotating latch 330. Specifically, the shaft 311 may indirectly connect with the rotating latch 330 via the rotating bracket 320 and be separable from the rotating latch 330. Accordingly, although the shaft 311 of the door handle 310 and the rotating bracket 320, integrally formed with the shaft 311, are damaged due to the forceful shock from the outside, the rotating latch 330 and the locking pin member 340 connected thereto may barely be damaged and thus maintain the locked state of the door 210.

Figure 8:
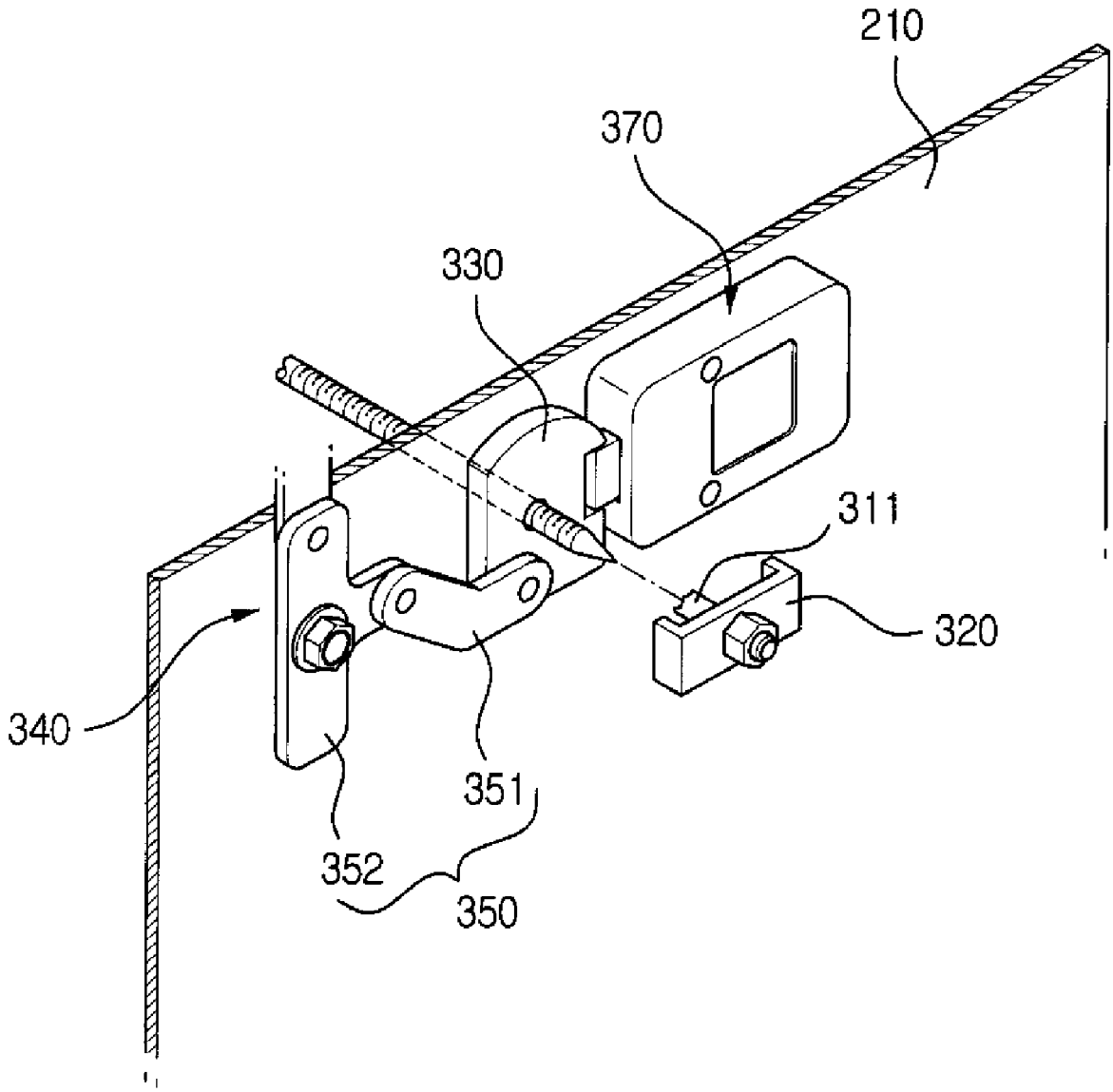
FIG. 8 is an exploded view illustrating an intrusion state of an unauthorized user attempting to open an object with a door locking device according to an exemplary embodiment of the present invention.

FIG. 8 is an exploded view illustrating an intrusion state of an unauthorized user attempting to open an object with a door locking device according to an exemplary embodiment of the present invention.

As illustrated in FIG. 8, a general method of opening an object, such as a safe, may include a method of using a drill, a chisel, and the like. Specifically, a method of applying a forceful shock from an outside, using a drill, a chisel, and the like, and thereby damaging a comparatively fragile door handle and a locking pin member connected thereto may be utilized.

However, according to the present invention, the shaft 311 of the door handle 310 indirectly connects with the rotating latch 330 via the rotating bracket 320, instead of directly connecting with the rotating latch 330. Accordingly, it is possible to delay the intrusion using the drill, the chisel, and the like. Specifically, although the door handle 310 and the rotating bracket 320 may be damaged due to the forceful shock from the outside, the rotating bracket 320 may be separated from the rotating latch 330. Accordingly, the unauthorized user needs to carry out another operation to disassemble the rotating latch 330. Specifically, it may take some time to open the safe 200 and thus the unauthorized user may not open the safe 200 within a comparatively shorter time.

As described above, according to the present invention, it is possible to safely secure an object needing a protection, such as a safe and a financial ATM.

Also, according to the present invention, even when a door handle and a shaft of the door handle are damaged due to a forceful shock from an outside, a rotating bracket and a rotating latch may be separated from each other. Accordingly, a locked state of a door may be maintained and thus an unauthorized user may not quickly open an object.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A door locking device comprising:

a door being mounted to an object to be capable of opening and closing a storage space of the object;

a door handle being provided on a external surface of the door;

a rotating bracket being mounted inside of the door to combine with a shaft of the door handle and thereby rotate together with the shaft;

a rotating latch being provided between the door and the rotating bracket to rotate with the door handle, and detachably coupled with the rotating bracket along an axial direction of the shaft, wherein the shaft passes through a shaft hole formed in the rotating latch without combination such that the rotating latch does not receive rotary power directly from the shaft;

a lock assembly being provided inside of the door to selectively restrain a rotation of the rotating latch; and a locking pin member being provided inside of the door to interoperate with the rotating latch, and selectively bind the door to the object according to a rotation manipulation of the door handle, wherein:

the rotating bracket is combined with the rotating latch to make a direct contact surface with at least one portion of a circumferential surface of the rotating latch, the shaft indirectly connects with the rotating latch via the rotating bracket and is separable from the rotating latch, and a plane of the direct contact surface is formed parallel to a rotation axis of the rotating bracket.

2. The door locking device of claim 1, wherein:

the rotating bracket is formed with at least one binding surface that makes the direct contact surface between the rotating bracket and the rotating latch to thereby restrain a relative rotation of the rotating bracket relative to the rotating latch, and a plane of the at least one binding surface is formed parallel to a rotation axis of the rotating bracket.

3. The door locking device of claim 2, wherein:

the rotating latch provides a first binding surface, and the rotating bracket provides a second binding surface formed corresponding to the first binding surface to be directly engaged with the first binding surface, and a plane of the first binding surface and a plane of the second binding surface are formed parallel to a rotation axis of the rotating bracket.

4. The door locking device of claim 1, wherein the lock assembly comprises:

a locking body being provided inside of the door; and a lock being received in the locking body to be selectively externally withdrawn from the locking body, and the withdrawn lock makes a surface contact with a circumferential surface of the rotating latch.

5. The door locking device of claim 4, wherein a locking groove is formed in a circumferential surface of the rotating latch to receive the lock.

6. The door locking device of claim 1, wherein the locking pin member comprises:

a link assembly rotatably connecting with the rotating latch; and a fixing pin rotatably connecting with the link assembly to thereby intemperate with the link assembly and be selectively protruded from the door, and a pinhole is formed in the object to receive a free end of the fixing pin.

7. The door locking device of claim 6, wherein the link assembly comprises:

a connecting link portion pivotably connecting with the rotating latch; and a rotating link portion rotatably connecting with the connecting link portion and the fixing pin to be rotatable on the door.

8. The door locking device of claim 6, further comprising:

a pin guide being provided to the door to guide the free end of the fixing pin to perform a linear motion.

9. The door locking device of claim 6, wherein a pair of fixings pins are provided to face each other, and the rotating link portion is provided between the pair of fixing pins.

* * * * *